United States Patent [19]

Hernick

[11] 4,086,982

[45] May 2, 1978

[54] APPARATUS FOR SUPPORTING AN AUTOMOBILE AT AN ELEVATION

[76] Inventor: Jack Frank Hernick, 6 Carousel Court, Toronto, Ontario, Canada, M6B 3M1

[21] Appl. No.: 738,022

[22] Filed: Nov. 2, 1976

[51] Int. Cl.[2] ..... B66F 7/18

[52] U.S. Cl. ..... 187/8.54

[58] Field of Search ..... 187/8.41, 8.43, 8.54, 187/8.74, 8.75

[56] References Cited

U.S. PATENT DOCUMENTS

| | | | |
|---|---|---|---|
| 1,911,204 | 5/1933 | Perry | 187/8.54 |
| 2,112,481 | 3/1938 | Cox | 187/8.54 |
| 2,552,974 | 5/1951 | Johnson | 187/8.54 |
| 3,557,908 | 1/1971 | Villars | 187/8.54 |
| 3,724,602 | 4/1973 | Hernick | 187/8.54 |
| 3,877,548 | 4/1975 | Hernick | 187/8.54 X |
| 3,985,207 | 10/1976 | Petit | 187/8.54 X |

FOREIGN PATENT DOCUMENTS

| | | | |
|---|---|---|---|
| 2,108,882 | 5/1972 | France | 187/8.54 |

*Primary Examiner*—Evon C. Blunk
*Assistant Examiner*—James L. Rowland

[57] ABSTRACT

The apparatus disclosed includes two posts to be installed erectly on opposite sides of a common car lift; a cantilever assembly slideable up and down on each post, means for interengaging the lift with each cantilever assembly to raise it when a car is being lifted and to drop it when the lift is being lowered, means for pinning the cantilever assemblies at selective levels on said posts, and arms on said cantilever assemblies retractably extendible to intercept a car being lowered by said lift and to retain it at an elevated position while the lift itself continues to lower to an out-of-the-way position leaving the entire underside of the car accessible for service.

7 Claims, 4 Drawing Figures

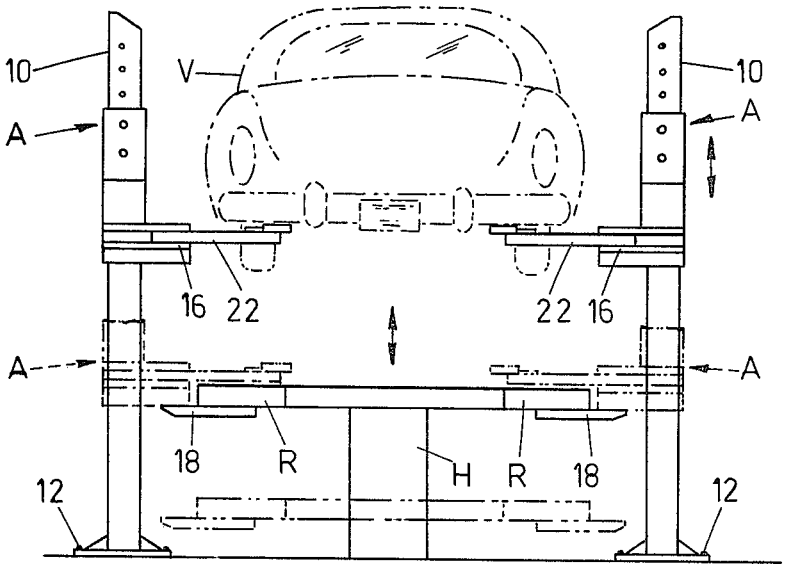
FIG. 3
FIG. 4
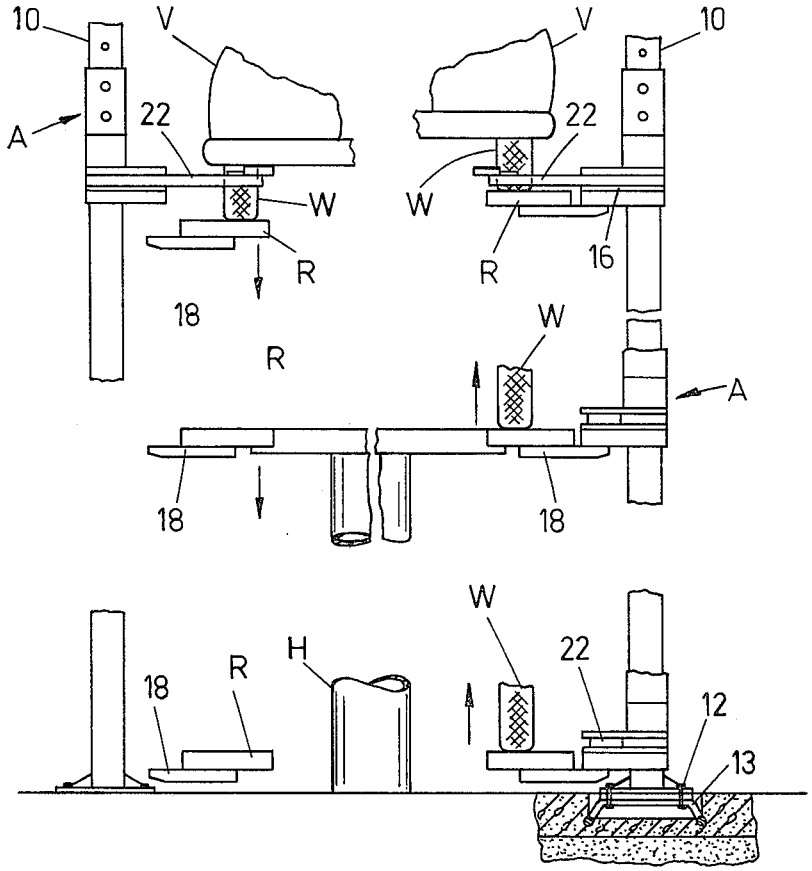

APPARATUS FOR SUPPORTING AN AUTOMOBILE AT AN ELEVATION

The invention relates to vehicle support apparatus in conjunction with a conventional automobile hoist for intercepting an automobile or like vehicle being lowered by said hoist and retaining it aloft while the hoist in lowered free of such vehicle whereby to provide free access to the underneath of the vehicle and leave it clear for working without obstruction.

Conventional hoists for raising and lowering cars are of two main types, namely, the frame lift or hoist which lifts a car by its frame and the wheel lift which is provided with wheel runways onto which the car is driven and on which it is stationed while it is being lifted in a known manner.

As will be apparent, while the frame hoist leaves the wheels free for removal, for tire changing, and so forth, it does nevertheless obstruct the underside of the vehicle and so restricts the work which can be performed thereon. Conversely, while the underside of the vehicle is left free, within limits, by the wheel lift it restricts the range of services which can be conveniently carried out on the wheels, the suspensions, and the like.

In the past, various modified forms of the two basic lifts described have been resorted to for elevating a car while leaving its underside and wheels totally free for working, and various accessories have also been added to the basic lifts for the same purpose. However, each of these expedients has suffered from one drawback or another.

The invention, therefore, seeks as one of its main objects, to provide vehicle support apparatus in conjunction with a conventional hoist as described for intercepting an automobile being lowered by said hoist and retaining and holding it aloft while the hoist is lowered (free of such automobile) so as to provide relatively full and free access both to the wheels and to the underside of the car for working thereon with minimal obstruction.

In particular, it is a further object of the invention to provide car interception means as aforesaid normally located close to the sides of the hoist but (in neutral or inoperative position) externally of its zone of operations; permitting free vertical movement of vehicles by and on said hoist; said interception facilities being movable into and out of operative, vehicle intercepting or operative position.

It is a still further object of the invention to provide such vehicle support apparatus which is simple to operate yet positive, efficient, reliable, and relatively foolproof in action.

A still further and very important object of the invention is to provide vehicle support apparatus as aforesaid of relatively simple construction adapted to surface installation; eliminating the need for digging or boring post holes or the like into the ground.

Yet a further object is to provide vehicle support means as described with an optional refinement in the nature of a catwalk which permits work to be performed, for example, on the engine compartment of an elevated car, as well as underneath it.

The foregoing and other self-evident objects of the invention are achieved by the provision of a hoist and a pair of posts to be rooted on or in the ground adjacent to and on opposite sides of the hoist, and cantilever assemblies respectively disposable and securable on said posts at selected elevations for intercepting a car being lowered by said hoist and for detaining and supporting it aloft, while the hoist is lowered to a neutral, out-of-the-way, position, so as to leave the wheels and the entire underside of the car virtually free for work to be performed thereof, said cantilever assemblies being raised to the desired height on the posts by and with the hoist as it raises a car to a commensurate elevation.

Preferably, the cantilever assemblies include sleeves respectively slideably engageable with and on the respective posts for free ascent and descent thereon; means such as projecting spurs being also provided for releasably interengaging said sleeves with said hoist to be raised thereby on the post when the hoist is elevated and, unless secured at said elevation, to descend when the hoist is lowered.

As further contemplated by the invention, the cantilever assemblies include support arms which are retractably extendible therefrom to intercept and support the car while the hoist is being lowered; said support arms being also retractable to a neutral position to avoid the interception described.

The invention further provides means as stated interengageable between the hoist and the cantilever assemblies for procuring raising of the cantilever assemblies by the upward movement of the hoist itself; said means being disengageable from the cantilever assemblies to permit lowering of the hoist independently of the cantilever assemblies.

More particularly, the invention seeks to provide support mechanism of the type indicated which may be fabricated separately from the car hoist, and which may simply be installed on site as an accessory to a conventional car hoist as described with little or no substantial modification of the hoist.

It is a further and related object sought to be achieved by the invention to provide apparatus having the foregoing advantages in which the vehicle is actually supported on support arms which are swingable under the chassis of the vehicle from each side thereof, leaving the underside thereof unobstructed, accessible, and free for working, and at the same time, releasing the vehicle wheels for removal, for example, if necessary for any work required on related parts of the vehicle.

The various features of novelty which characterize the invention are pointed out with particularity in the claims annexed and forming a part of this disclosure. For a better understanding of the invention, its operating advantages, and the specific objects attained by its use, reference should be had to the accompanying drawings and descriptive matter in which there are illustrated and described preferred embodiments of the invention.

In the drawings:

FIG. 3 is an end elevation view of the support apparatus with a vehicle supported thereon and with the associated hoist shown in two lowered positions, and FIG. 4 is a composite view of parts of a hoist and apparatus according to the invention with associated cantilever assemblies shown at different levels.

Figure 1:
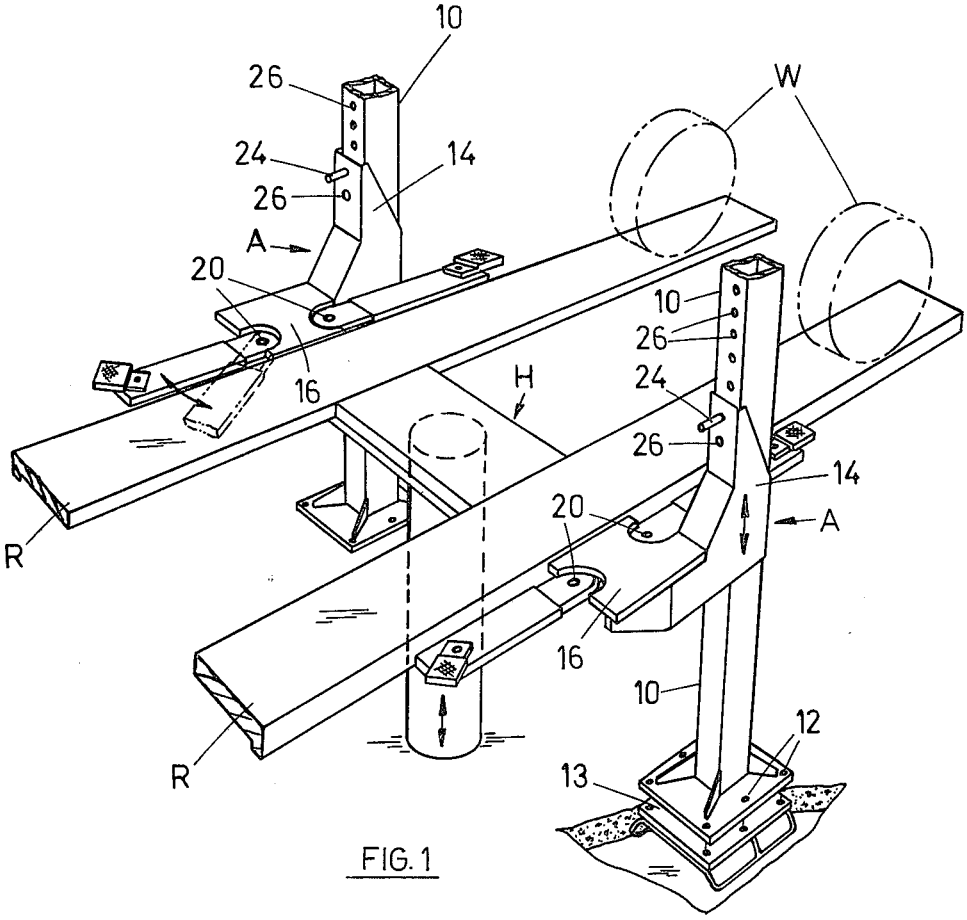
FIG. 1 is an isometric and largely schematic view of a vehicle support apparatus according to the invention associated with a wheel lift hoist as described, parts of which are broken away.
Figure 2:
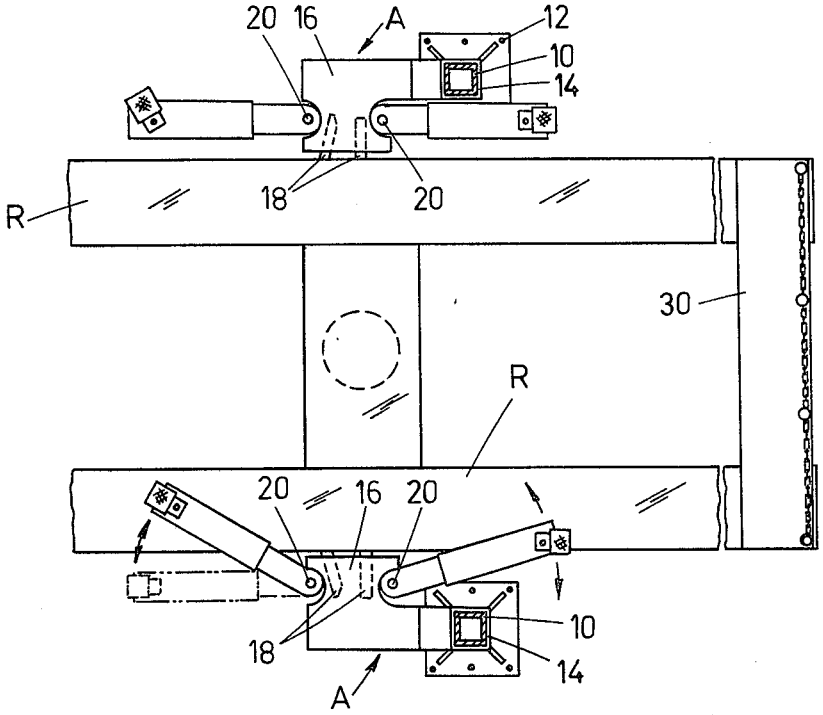
FIG. 2 is a top plan view of the support apparatus shown in FIG. 1.

Referring now to the drawing, the present invention is there shown as embodied in a vehicle support associated with a typical hoist H of the wheel lift type previously described which is equipped with runways R—R onto which a car may be driven to be raised and lowered by said hoist while it is standing on the runways substantially as pictured in FIGS. 3 and 4 of the drawing. It will be appreciated that the selection of this particular hoist for the expository purposes of this submission is not intended by way of limitation and is not to be so construed.

The support apparatus intended by this invention to be associated with the hoist H comprises the two posts 10—10 shown respectively stationed erectly at its sides, close to but externally nevertheless of its zone of operations so as not to interfere with its upward and downward movements as described between the posts 10—10.

As further shown in FIGS. 1 and 4, each post 10 is, in this embodiment, capable of being rooted on the ground by being bolted thereto in any conventional manner as at 12. Convenient facilities for this purpose may be the footing device 13 buried or cemented in the ground as shown in these views; the footing 13 being adapted to receive bolts 12 as will be understood.

Shown mounted on each post 10 in FIG. 1 and freely vertically movable thereon is a cantilever assembly A comprising a sleeve 14 which embraces post 10 to maintain cantilever assembly A in engagement therewith during its ascent and descent on the post 10.

Integrally attached to each sleeve 14 is a heavy flange 16 which extends therefrom towards hoist H but preferably not so much as to overlap the adjacent runway R forming part of hoist H.

Projecting from hoist H towards each cantilever assembly A is a pair of spurs 18—18 best seen in FIGS. 3 and 4 which underlie flanges 16 whereby to engage them when the hoist H is rising and thereby to elevate the sleeve 14 on the post 10. Being free to descend post 10 under its own gravity, the sleeve 14 will follow the hoist H downwardly when the latter is lowered.

In the present embodiment of the invention, each pair of spurs 18—18 is fastened by welding to the understructure of a runway R forming part of hoist H.

Flanges 16 are somewhat elongated to parallel runways R—R and at spaced points 20—20, support arms 22—22 are respectively mounted on each of them for swinging between the operative position to be described over the proximal runway R and the neutral position at one side of runway R in which it does not obstruct a vehicle being driven between posts 10—10, for example, to load it on runways R—R or to off-load it therefrom.

Thus, when the hoist H is lowered to ground level, a vehicle V may be driven on its runways R—R after which raising of hoist H procures engagement of each flange 16 by the proximal spurs 18—18 procuring simultaneous lifting of the entire cantilever assembly A as best shown on the right side of FIG. 4.

As and when the hoist H, vehicle V and cantilever assembles A—A have been raised to a desirable elevation, cantilever assemblies A—A may be temporarily detained at that elevation by insertion of a pin 24 in registering holes 26—26 provided on each cantilever assembly A and its post 10.

Expediently, a number of such holes 26 will be provided on each post 10 as well as on cantilever assembly A permitting a choice of levels at which the cantilever assembly A may be detained; the holes 26 being spaced appropriately for this purpose in an obvious and well-known manner.

When the cantilever assemblies A—A have been pinned as described the support arms 22—22 on each of them may be swung into operative position over a runway R, so as to underlie vehicle V between its wheels. Subsequent lowering of hoist H will also lower vehicle V while cantilever assembly A and its support arms 22—22 remain stationary because of the pinning of cantilever assembly A to post 10. Thus, the vehicle V will be lowered onto the support arms 22—22 after which hoist H may continue its descent without the vehicle which has been intercepted and retained aloft by support arms 22—22 on which it is now carried.

Obviously, the descent of hoist 10 to fully lowered position will leave the entire underside of the vehicle V exposed and accessible to service. In addition, its wheels will also be similarly accessible as will be apparent from FIG. 3.

The procedures just described are illustrated graphically in FIG. 4 which is a composite view showing a cantilever assembly A ascending a post 10 on the right side of this view and a runway R descending on the left side; three exemplary stations being illustrated on each side.

Dealing firstly with the ascent on the right-hand side of the view, the first or lowermost station illustrates a runway R at ground level with one visible spur 18 underlying flange 16 placed directly above it; the presence of a car on runway R being implied by a part of a front wheel W shown standing on runway R. It is at this level that the car be driven on or off runway R.

By the time the runway R has risen to the next higher station, the spur 18 will be seen to be in full engagement with flange 16 (as will also be its unseen counterpart) and, when it has reached the top station, cantilever assembly A is pinned to post 20 by pin 24 in the manner described; it being at this point that support arms 22—22 are spread into operative position from their previous retracted neutral position.

Descending then from the topmost station shown on the left side of this FIG. 4 runway R lowers vehicle V onto the outstretched support arms 22 and thereafter continues its descent while vehicle V is detained as will be obvious; the runway R passing unburdened through the intermediate station back to ground as shown in this view.

It need hardly be stated that the vehicle may be brought down from its elevated position by reversing the the procedure, i.e., by raising runways R—R to re-engage vehicle V, unpinning cantilever assemblies A—A and then lowering back to ground with the support arms 22—22 retracted to permit the vehicle to drive off the runways R—R when they are grounded.

It is noteworthy, however, that a further advantage is afforded by the invention inasmuch as the hoist H need not be lowered completely to the ground in cases where, for example, it is not desirable for the vehicle wheels to be completely pendent; a situation of this nature obtaining, for example, when work is being performed on the wheel suspension parts of the car.

Likewise, the hoist H may be used to lower the transmission or another heavy part of the vehicle, say, while the vehicle itself remains elevated on the cantilever assemblies A—A as suggested by FIG. 3.

It will be apparent that an important advantage is provided by the invention in that it makes both the underside of the vehicle V and its wheels accessible for servicing. The fact that both the underside and the wheels of the vehicle are thus accessible at the same time makes it possible for two or more servicemen to work on the vehicle whereby to expedite the servicing thereof; thereby limiting the time that the vehicle is required to spend on the hoist.

In turn and otherwise stated, this makes it possible for more vehicles to be serviced by a single hoist which thereby facilitates reduction in the number of hoists and in the area of shop space required therefor in service stations.

The utility of the hoist, from this aspect, may be enhanced still further by means bridging runways R—R at the front of the hoist H as at 30 to support a man performing service under the engine hood of the car while it is elevated.

Above all, however, the invention will be seen to have provided structure accessory to a hoist of the conventional type described, which is adated to co-operate therewith to create sophisticated apparatus described capable of raising and holding a vehicle aloft with its entire underside and wheels exposed, freed, and accessible for a wide range of automotive services.

The structure described is in the best mode presently known to the inventor for carrying the invention into practical effect. Nevertheless, it being obvious that the said structure is undoubtedly capable of modification in various respects, it will be understood that the true scope of the invention is as defined in the claims now following.

What I claim is:

1. Vehicle hoist and support apparatus comprising means for engaging a vehicle by its undercarriage;

a central elevator operable to raise and lower said vehicle engaging means together with the vehicle engaged thereby;

a pair of posts installable adjacent to the hoist and on opposite sides thereof;

cantilever assemblies respectively disposable on and securable to each said post at selected elevations for intercepting a vehicle being lowered on said vehicle engaging means and detaining and holding it aloft while the vehicle engaging means is thereafter lowered, free of the vehicle to a neutral out-of-the-way position;

a flange forming part of each said cantilever assembly extending towards said hoist, and means for releasably interengaging said cantilever assemblies with said vehicle engaging means to be raised thereby to said selected elevation when the vehicle is raised, said means comprising spurs extending from said vehicle engaging means to underlie said flanges.

2. Vehicle hoist and support apparatus as set forth in claim 1 wherein said cantilever assemblies include sleeves engageable with and freely movable up and down said posts.

3. Vehicle hoist and support apparatus as set forth in claim 1 wherein said cantilever assemblies include support arms secured to an retractably extendible from such flanges to underlie the vehicle being lowered by said hoist.

4. Vehicle hoist and support apparatus as set forth in claim 2 wherein said cantilever assemblies include vehicle support arms secured to and retractably extendible from said flanges to underlie said vehicle.

5. Vehicle hoist and support apparatus as set forth in claim 4 wherein said vehicle support arms are retractable from the extended position described to a neutral position in which they do not underlie and intercept the vehicle being lowered on the hoist.

6. Vehicle and hoist support apparatus as set forth in claim 5 including pins withdrawably installable in holes provided in said post for securing the cantilever assemblies at selected elevations on said posts.

7. Vehicle hoist and support apparatus as set forth in claim 6 wherein each said sleeve forms a collar about its post.

* * * * *